United States Patent [19]

Nicholls

[11] 4,059,821

[45] Nov. 22, 1977

[54] TRAFFIC SIGNAL CONTROLLER FLASHER FOR PEDESTRIAN CLEARANCE

[76] Inventor: Joseph A. Nicholls, 1729 Westwood Drive, Twinsburg, Ohio 44087

[21] Appl. No.: 721,498

[22] Filed: Sept. 8, 1976

[51] Int. Cl.[2] ..... G08G 1/00

[52] U.S. Cl. ..... 340/44; 315/226

[58] Field of Search ..... 340/44; 235/150.24

[56] References Cited

U.S. PATENT DOCUMENTS

| | | | |
|---|---|---|---|
| 3,196,388 | 7/1965 | Hill | 340/44 |
| 3,328,791 | 6/1967 | Casciato | 340/35 |
| 3,906,439 | 9/1975 | Hopla | 340/44 |

*Primary Examiner*—Thomas B. Habecker
*Attorney, Agent, or Firm*—A. W. Breiner

[57] ABSTRACT

An adapter unit converts a standard traffic controller system for operation to a pedestrian clearance mode where a DONT-WALK signal flashes during the interval when the green traffic signal is nearing the end of its period. The unit counts down line frequency to provide an on-off flash signal producing in the order of 55 flashes per minute and is interspersed in the connecting line between the standard controller switch and the pedestrian lamps. It operates with solid state circuits which are isolated from the controller's a-c voltage phases operating the traffic and pedestrian signal lamps.

5 Claims, 4 Drawing Figures

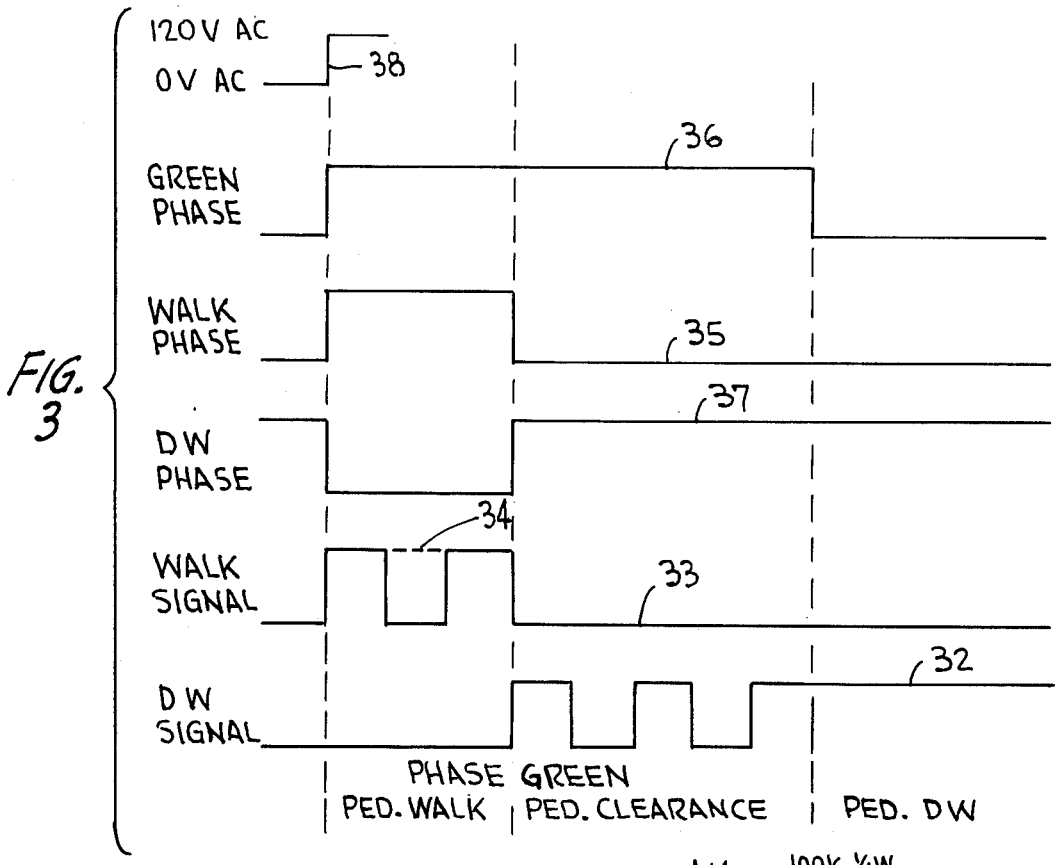
FIG. 3
FIG. 4
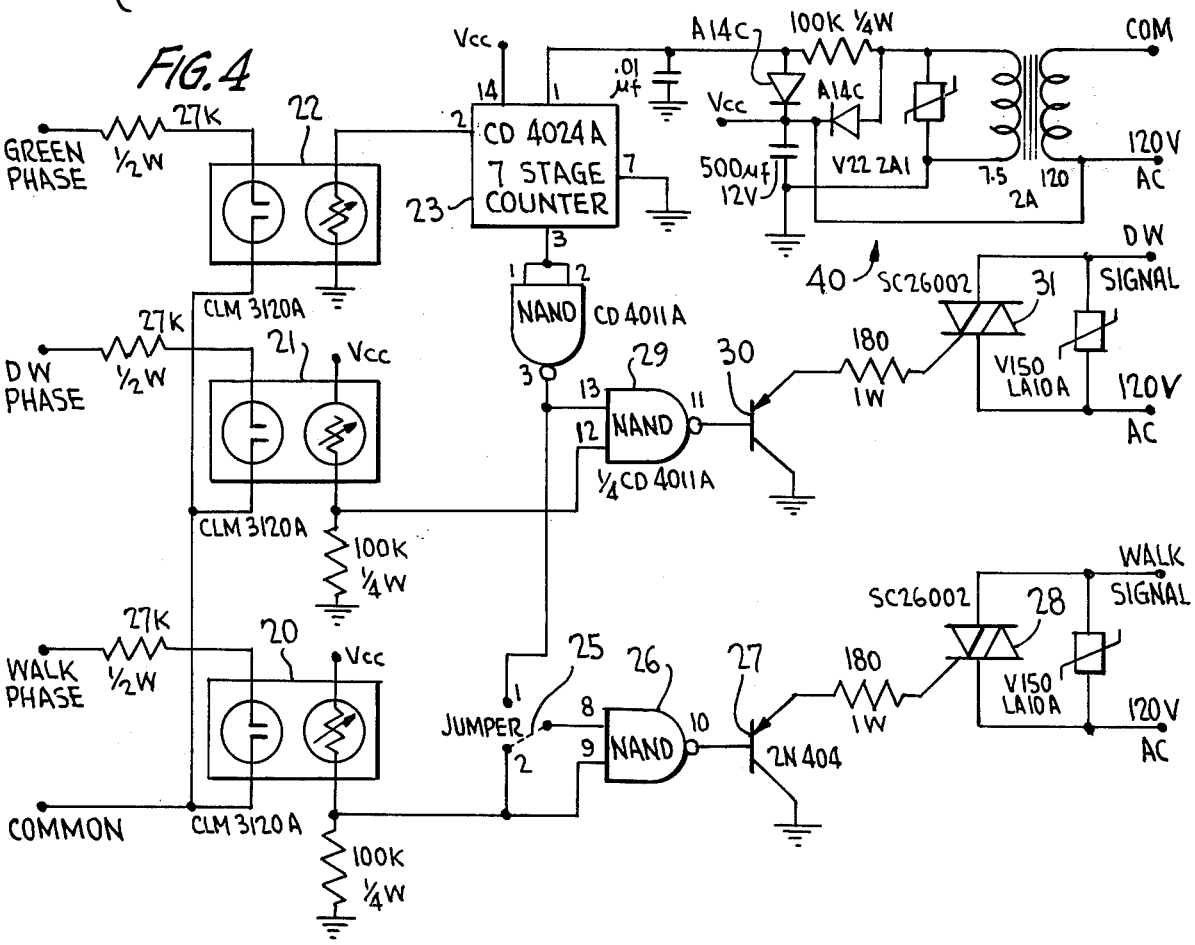

TRAFFIC SIGNAL CONTROLLER FLASHER FOR PEDESTRIAN CLEARANCE

This invention relates to traffic control signal systems and more particularly it relates to pedestrian control signals of the walk/dont-walk variety operating in conjunction with vehicle traffic signals.

BACKGROUND

Many traffic signals already installed are of the simple fixed cycle variety provided by an electro-mechanical cam drive system. These systems have limited load capacity and have no provisions for flashing a pedestrian dont-walk signal on and off during a clearance period. It is a significant problem to rework such systems in the field in both time and expense to conform such equipment for the flashing mode of operation. Although flashers are known, the use of prior art techniques such as shown in U.S. Pat. Nos. 3,286,230 and 3,383,653, for example, would result in extensive system change and the adoption of complex interface equipment.

Switching relays used in producing strobing signals for flashing pedestrian control lamps are not reliable over long operating periods since they tend to break heavy a-c load currents and arc; and, furthermore, they need an external strobing mechanism.

OBJECTS

Accordingly, it is a primary object of this invention to provide improved flasher equipment for use with presently installed types of traffic control systems without modification.

Another object of the invention is to provide a pedestrian clearance flashing mode of operation to traffic signal controllers without requiring extensive wiring or system change.

A still further object of the invention is to increase system capabilities of electro-mechanical traffic installations with improved pedestrian signals operating from compatible solid state plug-in type modular equipment.

BRIEF DESCRIPTION

Therefore, in accordance with the invention, a modular unit in a standard signal relay configuration plug-in style is used to adapt a cam type fixed sequence traffic controller switch to produce a flashing pedestrian control signal. The module operates in the pedestrian clearance mode by flashing a DONT-WALK indicator at a rate of about 55 times a minute in the latter part of the green traffic signal period before entering the steady state lighted DONT-WALK condition. The unit has self-contained solid state circuitry including power drive triac switches and optical isolators which interface with the standard a-c voltage phases of the traffic controller switching unit.

THE DRAWING

Further features, objectives, and advantages of the invention will be recognized from the following specification, and its accompanying drawing, in which:

FIG. 3 is a set of waveform diagrams illustrating the mode of operation of systems incorporating the present invention, and FIG. 4 is a schematic diagram of a preferred circuit embodiment of the invention.

THE DETAILED DESCRIPTION

Figure 1:
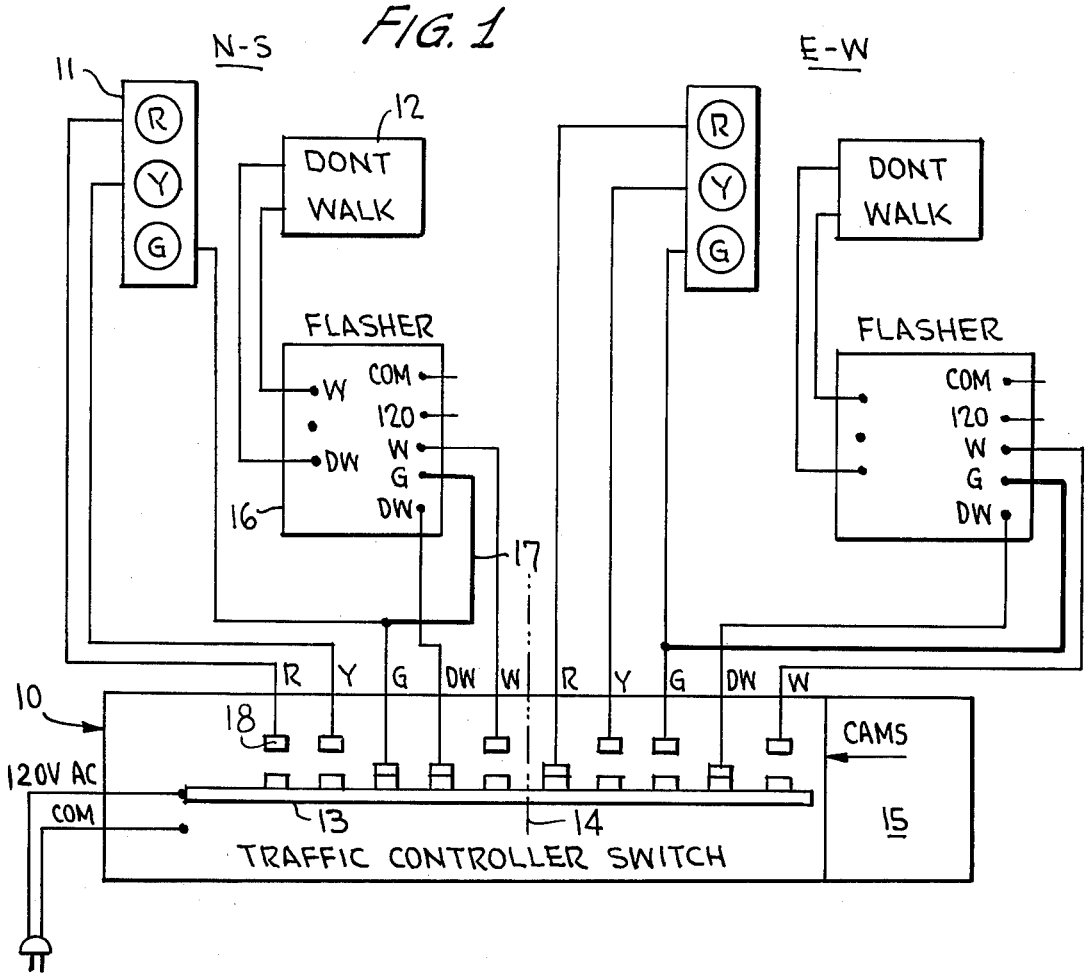
FIG. 1 is a block schematic diagram illustrating the improved traffic signal system and its mode of operation as afforded by this invention.

As shown in the FIG. 1 system, a typical cam operated fixed time cycle controller switch, such as Eagle Signal Company model EF-20 shown schematically at 10, controls a traffic system with traffic signals 11 and pedestrian signals 12 for two intersecting (N-S and E-W) streets. The shown controller switch assembly 10 has cams and controls 15 (not shown) which periodically close in sequence the red, yellow, and green traffic signal phase (R.Y.G.) switches 18, etc., to bus-bar 13 for the two respective cross streets at an intersection as divided by line 14. Thus, for example, green is closed for the N-S street and red is closed for the E-W street as illustrated.

As provided by this invention, flasher units 16 are connected between the pedestrian control signals W (WALK) and DW (DONT-WALK) from switch 10 and the intersection pedestrian conrol lamps 12. The block diagram form shown for flasher units 16 represents a plug-in unit in standard signal relay form configuration adopted for such systems, wherein only one additional wire 17 need be connected as shown in accented thickness between the green phase contact G and the input terminal marked G on the flasher. A separate flasher unit 16, which contains its own power drive circuits for operating the lamps 12, is used for each pedestrian control lamp system at the respective street E-W or N-S as shown.

Figure 2:
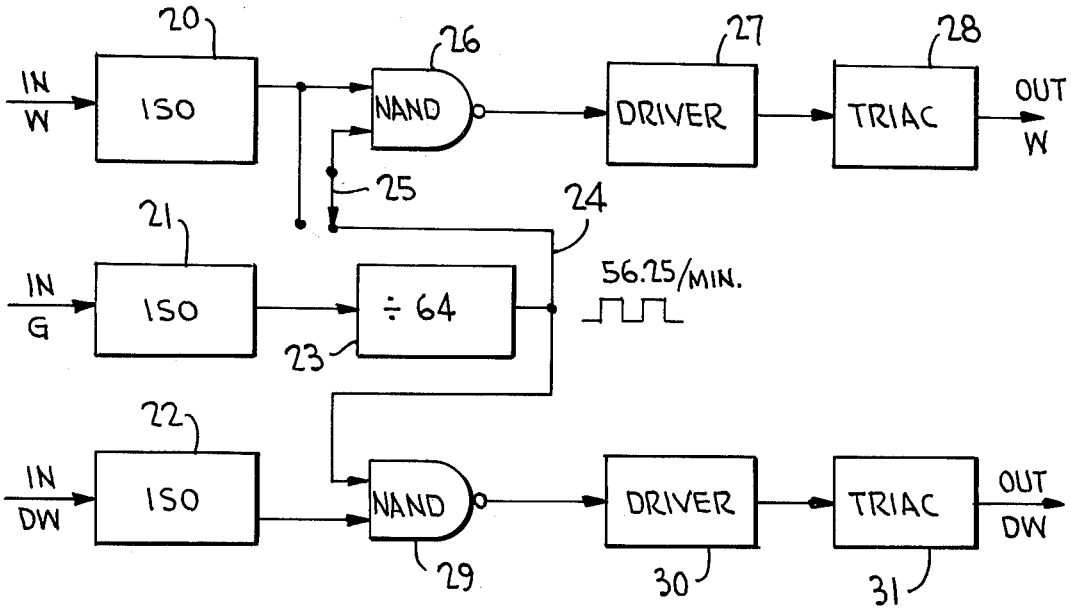
FIG. 2 is a block schematic diagram of the flashing circuitry provided by this invention.

The circuit configuration within plug-in flasher modular units 16 is illustrated in block-logic form in FIG. 2. It is seen that aside from the a-c power connections (not shown) that there are three signal input connections W, G, and DW processed by corresponding isolator devices 20, 21, 22 such as conventional optical isolators now available. This is important because the isolators eliminate breaking and making of a-c load or line currents at phase conditions causing arcing and shortened life, and furthermore serve as waveform shapers producing substantially square wave steady state d-c output waveforms at levels compatible for operating the solid state circuitry used in the modular flasher unit 16.

In the case of the green signal G, the isolator enables counter 23. Counter 23 derives its counting frequency from the 60 hz a-c line cycles, thereby providing in counter 23 a countdown of 64 readily attained efficiently in a binary countdown chain of a standard integrated circuit chip for example. This effects a flash rate between 50 and 60 a minute, namely 56.25 times a minute at output lead 24 as signified by the shown waveform.

Basically, isolator 20 and its line of equipment is optional, and can either be eliminated or selectively used by means of switch 25 only when it is desirable to have the standard WALK output signal W flashing. Thus, switch 25 as shown provides AND circuit 26 with a flashing mode that is eliminated by switching to the opposite switch position. The switch may be simply a jumper wire selectively connected as desired. Amplifier 27 and triac 28 provide output drive power selectively at switched on times for driving pedestrian control signal lamps in the WALK mode.

Similarly, AND circuit 29 with power driven amplifier 30 and triac 31 flashes a pedestrian control DONT-WALK lamp from output lead DW. Note, however, from waveform 32 in FIG. 3 that this flash mode occurs only during the pedestrian clearance phase in the latter part of the green phase, when the flasher counter 23 is operative.

The WALK signal can be flashing as shown in solid line in waveform 33 or, alternatively, can be selectively changed to steady state as indicated by dotted line 34. The relationship of the typical phases of the input and output signals are shown where the WALK phase 35 is for the initial part of the green phase 36 and is supplanted by a DONT-WALK phase 37 thereafter normally continuing until receipt of the next green phase signal. The power line notation 38 signifies the on-off power polarity of the remaining waveforms.

In FIG. 4 the schematic circuit configuration shows a simple parts complement of one power supply 40, three optical isolators, two integrated circuit chips, two transistors, and two high amperage triacs. All parts are standard, commercially available, and noted with appropriate parts designations. Corresponding reference characters identify the features hereinbefore discussed.

It is, therefore, evident that the state of the art has been improved by this invention, and that the disclosure shows those skilled in the art how to practice the invention. Therefore, those novel patentable features believed descriptive of the nature and spirit of the invention are defined with particularity in the appended claims.

What is claimed is:

1. The combination of a traffic controller switch operable from an a-c line voltage source producing periodic signals for both traffic signals sequencing said line voltage through red, green and yellow phases and pedestrian signals sequencing line voltage through WALK and DONT-WALK phases wherein the DONT-WALK phase overlaps the green phase and a control unit for flashing the pedestrian DONT-WALK signal through its initial part which overlaps the green phase consisting of a counter deriving from the a-c line frequency during the green phase a periodic flashing on-off signal preferably in the order of 55 flashes a minute and a logic AND circuit deriving an output DONT-WALK signal conjointly from the DONT-WALK phase and the flashing signal.

2. The combination defined in claim 1, wherein the flasher unit is a modular unit selectively insertable intermediate the pedestrian phases and a corresponding set of pedestrian signal lamps and consists of line voltage isolators obtaining signals from the green phase and the pedestrian phases, a line voltage connection, solid state circuitry in said counter connection deriving said flashing signal, and solid state pedestrian signal lamp driver devices responsive to gate said line voltage connections to at least one of said pedestrian signal lamps in a flashing mode.

3. A modular traffic signal controller unit operable from an a-c line for converting to a flashing mode a traffic signal system sequencing traffic signals through red, green, and yellow phases and pedestrian signals through WALK and DONT-WALK phases with the DONT-WALK phase partly overlapping the green phase, consisting in combination, isolator inputs for deriving WALK, DONT-WALK and green phases from said system, a counter responsive to the a-c line frequency enabled by the green phase to divide it down thereby obtaining an on-off flashing signal preferably exhibiting in the order of 55 flashes per minute, logic AND circuitry producing an output DONT-WALK phase signal responsive conjointly to the flashing signal and the input DONT-WALK phase, an a-c line input, and solid state pedestrian signal lamp power drivers operable from said line input and the output DONT-WALK phase signal thereby to produce output flashing of the DONT-WALK output power signals during the overlap period of the input green and DONT-WALK phases.

4. A unit as defined in claim 3 including in addition a further logic AND circuit optionally selectable to produce a flashing output pedestrian signal lamp signal for the WALK phase from the conjoint presence of the flashing signal and the input WALK phase signal, and a further solid state pedestrian lamp signal driver operable from the output WALK phase signal and line input to produce output WALK phase power signal.

5. The unit defined in claim 3 contained in a plug-in configuration for fitting a standard relay receptacle.

* * * * *